US008809211B2

(12) United States Patent
Ueda

(10) Patent No.: US 8,809,211 B2
(45) Date of Patent: Aug. 19, 2014

(54) INDUSTRIAL TWO-LAYER FABRIC

(75) Inventor: Ikuo Ueda, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 25 days.

(21) Appl. No.: 13/305,330

(22) Filed: Nov. 28, 2011

(65) Prior Publication Data

US 2012/0135656 A1 May 31, 2012

(30) Foreign Application Priority Data

Nov. 30, 2010 (JP) ..... 2010-267192

(51) Int. Cl.

| | |
|---|---|
| ***D03D 11/00*** | (2006.01) |
| ***D03D 13/00*** | (2006.01) |
| ***D03D 25/00*** | (2006.01) |
| ***D21F 1/00*** | (2006.01) |

(52) U.S. Cl.
USPC ..... 442/206; 442/203; 442/205; 139/383 AA

(58) Field of Classification Search
USPC ..... 442/203, 205, 206, 204; 139/383 A, 139/383 AA, 408
See application file for complete search history.

(56) References Cited

U.S. PATENT DOCUMENTS

| | | | | |
|---|---|---|---|---|
| 4,071,050 | A * | 1/1978 | Codorniu | 139/383 A |
| 7,306,014 | B2 * | 12/2007 | Nagura et al. | 139/383 AA |
| 7,445,032 | B2 * | 11/2008 | Barrett et al. | 139/383 AA |
| 7,484,537 | B2 * | 2/2009 | Ueda | 139/383 A |
| 7,882,857 | B1 * | 2/2011 | Ueda | 139/383 A |
| 2003/0010393 | A1 * | 1/2003 | Kuji | 139/383 A |
| 2003/0217782 | A1 * | 11/2003 | Nagura et al. | 139/383 A |
| 2006/0048838 | A1 * | 3/2006 | Takimoto | 139/383 A |
| 2008/0264511 | A1 * | 10/2008 | Boeck | 139/383 A |
| 2009/0283233 | A1 * | 11/2009 | Boeck et al. | 162/202 |
| 2012/0135657 | A1 * | 5/2012 | Ueda | 442/203 |

FOREIGN PATENT DOCUMENTS

| | | | | |
|---|---|---|---|---|
| EP | 672782 | A1 * | 9/1995 | D21F 1/00 |
| JP | 2004-68168 | A | 3/2004 | |

* cited by examiner

*Primary Examiner* — Jeremy R Pierce
(74) *Attorney, Agent, or Firm* — Rader, Fishman & Grauer PLLC

(57) ABSTRACT

An industrial two-layer fabric includes an upper side fabric and a lower side fabric. The upper side warps of the upper side fabric comprise a first warp set and a second warp set. The first warp set contains two upper side warps and a warp binding yarn that binds the upper side fabric and the lower side fabric. The two upper side warps are woven with the same upper side wefts. The second warp set contains one upper side warp. At a position where the warp binding yarn passes above one of the upper side wefts, the warp binding yarn is placed between the two upper side warps of the first warp set and pass below the same one of the upper side wefts, whereby the two upper side warps and the warp binding yarn of the first warp set form the upper side warp design.

11 Claims, 4 Drawing Sheets

Related Art

INDUSTRIAL TWO-LAYER FABRIC

CROSS-REFERENCES TO RELATED APPLICATION

This application claims priority from Japanese Patent Application Serial No. 2010-267192 filed Nov. 30, 2010, the contents of which are incorporated herein by reference in their entirety.

BACKGROUND OF THE INVENTION

1. Field of the Invention

The present invention relates to an industrial two-layer fabric free of misalignment of a binding yarn at an interwoven position, excellent in rigidity, water drainability, wear resistance, and fiber supporting property, and exhibiting uniform dehydration characteristics throughout the fabric.

2. Description of the Related Art

Fabrics obtained by weaving warps and wefts have conventionally been used widely as an industrial fabric. They are, for example, used in various fields including papermaking fabrics, conveyor belts, and filter cloths and are required to have fabric properties suited for the intended use or using environment. Of such fabrics, a papermaking fabric used in a papermaking step for removing water from raw materials by making use of the mesh openings of the fabric must satisfy a severe demand. For example, there is therefore a demand for the development of fabrics that have excellent surface smoothness and do not transfer a wire mark of the fabric to paper, have a dehydration property to sufficiently and uniformly dehydrate excessive water contained in the raw materials, have enough rigidity and wear resistance which enable suited use even under severe environments, and are capable of maintaining conditions necessary for making good paper for a prolonged period of time. In addition, they are required to have a fiber supporting property, improved papermaking yield, dimensional stability, running stability, and the like. In recent years, owing to the speed-up of a paper making machine, requirements for papermaking fabrics become severer.

Most of the demands for industrial fabrics and solutions thereof can be understood from a description on papermaking fabrics on which the most severe demand is imposed among industrial fabrics. A description will next be made with the papermaking fabric as an example.

With a recent increase in the speed of a papermaking machine, papermaking fabrics are required to have a particularly excellent dehydration property and surface smoothness. Although dehydration characteristics which they are required to have differ with the type of a papermaking machine or the type of a product to be manufactured, a uniform dehydration property is one of essential conditions for any product. Further, it becomes more difficult to satisfy the demand for papermaking fabrics because an increase in a mixing rate of minute fibers in raw materials as a result of recent increased use of waste paper causes insufficient dehydration so that sufficient and uniform dehydration has gained in importance.

As fabrics exhibiting a good dehydration property, there are two-layer fabrics having a dehydration hole penetrating through from the upper surface side to the lower surface side thereof. In particular, as fabrics designed to satisfy a surface property, fiber supporting property, and dehydration property which papermaking fabrics are required to have, two-layer fabrics using a warp binding yarn to be woven with an upper side weft and a lower side weft to form an upper side warp design and a lower side warp design, respectively, are known.

Japanese Patent Laid-Open No. 2004-36052 discloses a two-layer fabric using a warp binding yarn. The fabrics of such related art are two-layer fabrics using some of warps as a warp binding yarn functioning as a binding yarn for weaving an upper side layer and a lower side layer. The warp binding yarn constituting a set complements an upper side warp design and a lower side warp design to form each of the surface designs so that fabrics thus obtained are excellent in surface property and binding strength.

Japanese Patent Laid-Open No. 2004-68168 discloses a two-layer fabric having a set of an upper side warp and a warp binding yarn with a view to achieving a uniform dehydration property. This fabric has a uniform design on the surface thereof by using an upper side knuckle of the warp binding yarn for weaving upper and lower surfaces and an upper side warp design in combination. In this fabric, the binding yarn lies on one side because the warp binding yarn binds them at a position where an upper warp design is partially broken. It inevitably leads to a transferred wire mark or a dehydration mark.

The conventional two-layer fabric has, throughout the fabric, dehydration holes completely penetrating through from the upper side layer to the lower side layer so that it has a good dehydration property. Sheet raw materials on a wire stick to the fabric due to powerful vacuuming or the like or fibers, fillers, and the like are fallen from the wire, which may cause a marked increase in dehydration marks. As described above, industrial fabrics capable of satisfying any of the necessary properties such as surface property, fiber supporting property, and wear resistance have not yet been developed.

SUMMARY OF THE INVENTION

An object of the invention is to provide an industrial two-layer fabric free of misalignment of a binding yarn at an interwoven position, exhibiting uniform dehydration characteristics throughout the fabric, excellent in surface smoothness, rigidity, water drainability, wear resistance, and fiber supporting property, and capable of preventing an increase in the thickness of a wire.

In the industrial two-layer fabric according to the invention, a binding yarn is placed between two warps of a first warp set in an upper side fabric so that binding portion can be formed without collapsing the surface design of the fabric.

The following constitution is employed in order to overcome the problem of the related art.

An industrial two-layer fabric of the present invention includes an upper side fabric and a lower side fabric. The upper side fabric has upper side warps and upper side wefts. Each of the upper side warps forms an upper side warp design. The upper side fabric weave design is formed by weaving the upper side warps and upper side wefts. The lower side fabric has lower side warps and lower side wefts. The upper side warps comprise a first warp set and a second warp set.

The first warp set contains two of the upper side warps and a first one of the lower side warps. The two of the upper side warps are woven with the same upper side wefts. The one of the lower side warps functions as a warp binding yarn and is woven with an upper side weft and a lower side weft thereby binds the upper side fabric and the lower side fabric. The second warp set contains one of the upper side warps.

At a position where the warp binding yarn (the lower side warp that functions as a warp binding yarn) of the first warp set passes above one of the upper side wefts, the warp binding yarn is placed between the two upper side warps of the first warp set. The two upper side warps at the position pass below the same one of the upper side wefts, whereby the two upper side warps and the warp binding yarn of the first warp set form the upper side warp design.

The second warp set may further contain one of the lower side warps placed below the upper side warp. The second warp set may contain two of the upper side warps that weave the same upper side wefts with or without one of the lower side warps. Namely, in the latter case, the second warp set may have two upper side warp and one lower side warp placed below the two upper side warps. The second warp set may contain two of the upper side warps and two of the lower side warps placed below the two upper side warps respectively.

The upper side warp design industrial two-layer fabric comprised of a first warp set and the upper side warp design comprised of a second warp set are arranged alternately.

Any of the lower side warps may function as a binding yarn that binds the upper side fabric and the lower side fabric by passing one of the upper side wefts and passing under at least one the lower side wefts in a minimum repeating unit.

The invention has an excellent effect of providing an industrial two-layer fabric exhibiting a uniform dehydration property throughout the fabric while preventing misalignment of a binding yarn at an interweaving position, having excellent surface smoothness, rigidity, water drainability, wear resistance, and fiber supporting property, and capable of preventing an increase in the thickness of a wire or a fabric.

DESCRIPTION OF THE PREFERRED EMBODIMENT

Figure 1:
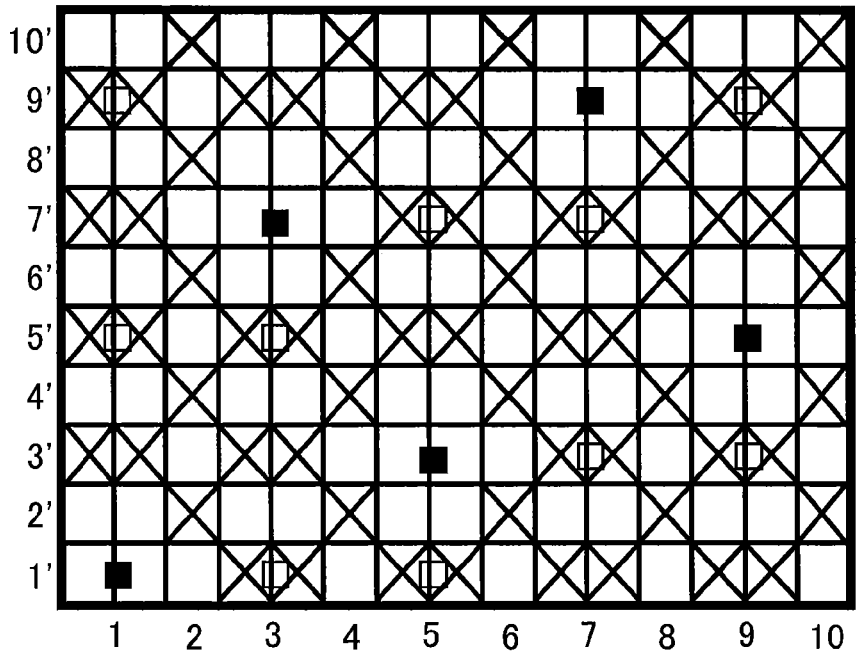
FIG. 1 is a design diagram showing a complete design of Example 1 of the invention.

Embodiments of the industrial two-layer fabric according to the invention will next be described. The following embodiments are only examples of the invention and do not limit the invention.

The industrial two-layer fabric according to the invention is that a binding yarn is woven with an upper side weft between two upper side warps of a first warp set at a position in an upper side fabric to form an upper side warp design in cooperation with the first warp set. The two upper side warps at the position pass below the same one of the upper side wefts, whereby the two upper side warps and the warp binding yarn of the first warp set cooperatively form the upper side warp design.

The upper side complete design is comprised of an upper side warp design having a first warp set and an upper side warp design having a second warp set or comprised only of the first warp sets placed successively. The upper side warp design having a first warp set and the upper side warp design having a second warp set may be placed alternately.

In the present embodiment, the binding yarn is woven, from the lower surface side, between the two warps of the first warp set on the upper side. The warps of the first warp set therefore move to both sides of the binding yarn, respectively, so that no misalignment of the binding yarn occurs.

On the other hand, in the conventional fabrics, at a position where two upper and lower warps replace each other and bind upper and lower side layers, the upper warp design is broken and warps lie on one side. As a result, paper manufactured using the resulting fabric is likely to have a dehydration mark or a transferred wire mark.

In the present embodiment, the binding yarn binds an upper wire or fabric from the lower surface side between two warps. The warp having a binding function (the binding yarn) is characterized in that when it is woven with an upper side weft, it is placed at the center of a position where the upper side warps of the first warp set are woven simultaneously with the same upper side weft. This makes it possible to form the upper side warp design without causing misalignment of the binding yarn, leading to improvement in surface smoothness. In addition, two warps of the first warp set are moved or pushed to and placed at both sides of the binding yarn respectively, so that a dehydration route does not shift to one side and accordingly water drainability is improved.

No particular limitation is imposed on the upper side fabric weave design and any of plain weave, twill weave, broken twill weave, satin weave, randomly shifted satin weave, and the like design can be employed. Complete designs obtained using it are connected longitudinally and latitudinally to obtain a design excellent in diagonal rigidity, running stability, and wear resistance. The upper side fabric may be an upper side complete weave design comprised of plural kinds of warp designs. Alternatively, auxiliary wefts having a smaller diameter than upper side wefts may be placed between upper side wefts.

No particular limitation is imposed also on the lower side surface design. For example, preferred is a design in which a lower side weft passes over two successive lower side warps and/or warp binding yarns and then passes under two or more successive lower side warps and/or warp binding yarns to form a long crimp of the lower side weft on the lower side surface. By employing a design in which two adjacent warps (a lower side warp and a warp binding yarn or two lower side warps) on the lower surface side are simultaneously woven with a single lower side weft, the long crimp of the lower side weft protrudes further than the warp binding yarns from the surface so that the resulting fabric has improved wear resistance and at the same time improved rigidity. It is also recommended that the two adjacent warps are woven with a lower side weft from the lower surface side and at this position, alternately approach warps lying on both sides, thereby forming substantially zigzag arrangement of warps.

Yarns to be used in the present embodiment may be selected depending on the intended use. Examples of it include, in addition to monofilaments, multifilaments, spun yarns, finished yarns subjected to crimping or bulking such as so-called textured yarn, bulky yarn, and stretch yarn and yarns obtained by intertwining them. As the cross-section of the yarn, not only circular shape but also square or short shape such as stellar shape, or elliptical or hollow shape can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool, and metal. It is needless to say that yarns obtained using copolymers or incorporating or mixing the above-described material with a substance selected depending on the intended use may be used. As upper side warps, lower side warps, lower warp binding yarns, and upper side wefts for a papermaking wire, use of a polyester monofilament having rigidity and excellent dimensional stability is usually preferred. As lower side wefts which need wear resistance, those obtained by interweaving of polyester monofilaments and polyamide monofilaments, for example, by arranging them alternately are preferred from the standpoint of improving wear resistance while maintaining rigidity.

In the present embodiment, the diameter of the warps in the upper side warp design comprised of the first warp set may be smaller than that of the warp in the upper side warp design comprised of the second warp set. A load to be applied to wefts upon formation of a knuckle may be made almost equal to that to be applied to the second warp set by decreasing the diameter of the warps of the first warp set, which is effective for improving surface smoothness, fiber supporting property, and the like. In addition, the diameter or material of the warps can be selected as needed because the diameter can be adjusted by selecting it depending on the material of the warps.

The fabric of the present embodiment is formed by placing, as the warps constituting the upper side surface, two kinds, that is, a first warp set (two-upper warp and one-binding yarn set) and a second warp set (one-upper warp with or without one-lower warp set) or the first warp set and the second warp set with an additional upper side warp (two-upper warp with or without one-lower warp). In the fabric of the present invention, a binding yarn, which is one of lower side warps, is made to appear between the two upper side warps of the first warp set on the upper surface side of the two-layer fabric upon binding upper and lower wires (or fabrics) so that the surface design of the fabric can be formed without changing the shape or without providing a position where warps replace and cross each other and at the same time, the warp binding yarn lies always at the same position over an upper side weft where an upper side warp lies over the same upper side warp if the warp binding yarn is not present. Since different from the related art, the two-layer fabric of the present invention has no position where warp binding yarns cross each other between the upper side fabric and the lower side fabric, the two-layer fabric is free of misalignment in a direction parallel to the fabric surface (which will hereinafter be called as the "horizontal direction") or one-sided alignment.

In addition, in the fabric of the present invention, a ratio of warps on the lower surface side is smaller than that of warps on the upper surface side so that a sufficient dehydration route is ensured. Judging from the above, the mesh openings on the upper surface side are likely to be clogged compared with the conventional fabric, but a dehydration route in a direction perpendicular to the fabric surface (which will hereinafter be called as the "perpendicular direction") is always secured so that this upper surface side design does not adversely affect the dehydration property. It is needless to say that the dehydration route in an oblique direction is also secured so that there occurs no partial clogging of the mesh openings of the upper side fabric. The structure of the present invention has therefore remarkable effects for achieving a uniform dehydration property and excellent surface smoothness.

Examples of the industrial two-layer fabric according to the invention will hereinafter be described based on accompanying drawings. FIGS. 1 to 4 are design diagrams showing examples relating to the industrial two-layer fabric of the invention. The term "design diagram" as used herein means a minimum repeating unit of a fabric design, which is also known as a complete design, and a whole fabric design is formed by connecting this complete design longitudinally and latitudinally. In these design diagrams, warps are indicated by Arabic numerals, for example 1, 2 and 3. In the present examples, warps on the upper surface side are a set of two upper side warps and a set of a single upper side warp and warps on the lower surface side are a lower side warp and a binding yarn. Wefts are indicated by Arabic numerals with a prime, for example, 1', 2' and 3'. According to an arrangement ratio, an upper side weft and a lower side weft may be placed perpendicularly or only an upper side weft is placed. In the diagrams, a cross "x" indicates that an upper side warp lies over an upper side weft, a solid square "■" indicates that a binding yarn lies over an upper side weft, an open square "□" indicates that a binding yarn lies under a lower side weft, and an open circle "○" (including an elliptical shape in the drawing) indicates that a lower side warp lies under a lower surface side weft. An upper side warp and a lower side warp, or an upper side weft and a lower side weft perpendicularly overlap with each other. With regards to wefts, upper side wefts do not always have a lower side weft thereunder, depending on the arrangement ratio. In the design diagram, yarns are perpendicularly overlapped precisely. They are however illustrated as such for convenience of drawing and misalignment is allowed in the actual fabric.

EXAMPLE 1

FIG. 1 is a design diagram of an industrial two-layer fabric of Example 1 according to the invention. This fabric is a 10-shaft fabric in which a set of upper and lower warps (1, 3, 5, 7, 9) comprised of two upper side warps and a binding yarn and a set of a single upper side warp (2, 4, 6, 8, 10) is arranged alternately.

In FIG. 1, upper side wefts (1', 2', 3', 4', 5', 6', 7', 8', 9', 10') and lower side wefts (1', 3', 5', 7', 9') are arranged at a ratio of 2:1. The presence of the lower side wefts is identified at the rows that white squares appear in FIG. 1.

In the upper side fabric, an upper side warp alternately passes over (shown as X in a box in FIG. 1) and under an upper side weft (shown as blank box in FIG. 1) and thus forms a 1/1 upper side warp design (plain weave fabric design in combination with upper side wefts) and at the same time, a first warp set of two upper side warps and a binding yarn (1, 3, 5, 7 or 9) and a second warp set of a single upper side warp (2, 4, 6, 8 or 10) are arranged alternately. The two upper side warps of the first warp set (1, 3, 5, 7 or 9) are each woven with the same upper side weft (1', 3', 5', 7' or 9') and as a set, constitute a 1/1 upper side warp design corresponding to a single warp that is generally placed in a plain weave fabric.

The binding yarn of the first warp set is placed under the two upper side warps of the first warp set and binds an upper side fabric and a lower side fabric while appearing from between the two upper side warps of the first warp set. At a position where the warp binding yarn (1, 3, 5, 7 or 9) passes above one of the upper side wefts (1', 7', 3', 9', 5', respectively) as shown by a black square "■", the warp binding yarn (1, 3, 5, 7 or 9) is placed between the two upper side warps (1, 3, 5, 7 or 9) of the first warp set, the two upper side warps at the position pass below the same one of the upper side wefts (1', 7', 3', 9', 5', respectively), as shown by blank boxes, whereby the two upper side warps and the warp binding yarn of the first warp set form the 1/1 upper side warp design.

The second warp set of a single upper side warp adjacent to the first warp set forms the same 1/1 upper side warp design and forms a plain weave fabric design while shifting the 1/1 first warp set design by one upper side weft equivalent distance.

Described specifically, upper side warps 1 of the first warp set form, as a set, a design corresponding to a warp of a general plain weave fabric. It does not pass over an upper side weft 1' over which it is originally supposed to pass, passes under an upper side weft 2', over an upper side weft 3', under an upper side weft 4', and over an upper side weft 5', under an upper side weft 6', over an upper side weft 7', under an upper side weft 8', over an upper side weft 9', and under an upper side weft 10'. An upper side warp 2 of a second warp set adjacent thereto forms a design similar to that of the two upper side warps of the first warp set, but it forms a plain weave design by shifting the design by one upper side weft equivalent distance. More specifically, the second warp set passes over the upper side weft 2' and then passes under the upper side weft 3' and continues to form a 1/1 upper side warp design and to form a plain weave design in combination with the first warp set and upper side wefts.

No limitation is imposed on the design of the lower side fabric. In Example 1, the fabric has a long crimp of a lower side weft so that it has a good wear resistance. More specifically, the warp binding yarn 1 which is a lower side warp passes under the lower side wefts 5' and 9' and over lower side wefts 1', 3', and 7' and thus forms a 1/2-1/1 lower warp design. In other words, the warp binding yarn 1 passes under one lower side weft 9', over two lower side wefts 1' and 3', below one lower side weft 5' and over one lower side weft 7'.

The binding yarn 1 is woven with the upper side weft 1' and with the lower side wefts 5' and 9'. The binding yarn 3 adjacent thereto passes under the lower side wefts 1' and 5' and over lower side wefts 3', 7', and 9' and thus forms a 1/2-1/1 lower warp design. The binding yarn 3 is woven with an upper side weft 7'. The binding yarn 3 forms a 1/2-1/1 lower warp design by shifting the lower warp design of the binding yarn 1 by three-lower side weft equivalent distance upward in FIG. 1.

In the conventional fabrics, there is a difference between a set of a binding yarn and a set of a warp in the overlapping manner of an upper side warp and a lower side warp. The set of a warp is a set of an upper side warp and a lower side warp in which the upper side warp is woven with only an upper side weft and the lower side warp is woven with only a lower side weft. When a wire is viewed perpendicularly from the upper surface side to the lower surface side, the upper and lower warps substantially overlap each other. With regards to the set of a binding yarn, on the other hand, two warps are placed perpendicularly. One of them should be woven with both upper and lower wefts and a design corresponding to a single warp should be formed so that there exists a position where these two warps replace each other. Different from the set of a warp, the warps of the set of a binding yarn do not completely overlap each other perpendicularly. In particular, at a position where the two warps replace each other, they are arranged side by side so that the mesh openings are clogged at this position, which may become a factor for clogging of a dehydration route, deterioration in smoothness on the surface of the fabric, and the like and as a result, cause dehydration marks.

On the other hand, the fabric of Example 1 has two kinds of warps for forming an upper side surface, that is, a set of two upper side warps and a set of a single upper side warp. In binding upper and lower fabrics to each other in Example 1, the binding yarn binds them while appearing from the first warp set so that the surface design can be formed without changing a shape or without replacing two warps each other and at the same time, the two warps always exist at the same position. Different from the conventional fabric having a replacement position of warps, neither misalignment in a horizontal direction nor one-sided alignment occurs. In addition, in Example 1, since a ratio of warps on the lower surface side is smaller, a sufficient dehydration route can be ensured. Judging from the above, the mesh openings on the upper surface side are likely to be clogged compared with the conventional fabric, but a dehydration route in a perpendicular direction is secured constantly so that this design does not adversely affect the dehydration property. It is needless to say that the dehydration route in an oblique direction is also secured so that there occurs no partial clogging of the mesh openings. The structure of the present example has therefore remarkable effects for achieving a uniform dehydration property and excellent surface smoothness. Such a structure and function can be understood from the comparison between FIG. 5 and FIG. 7.

Figure 5:
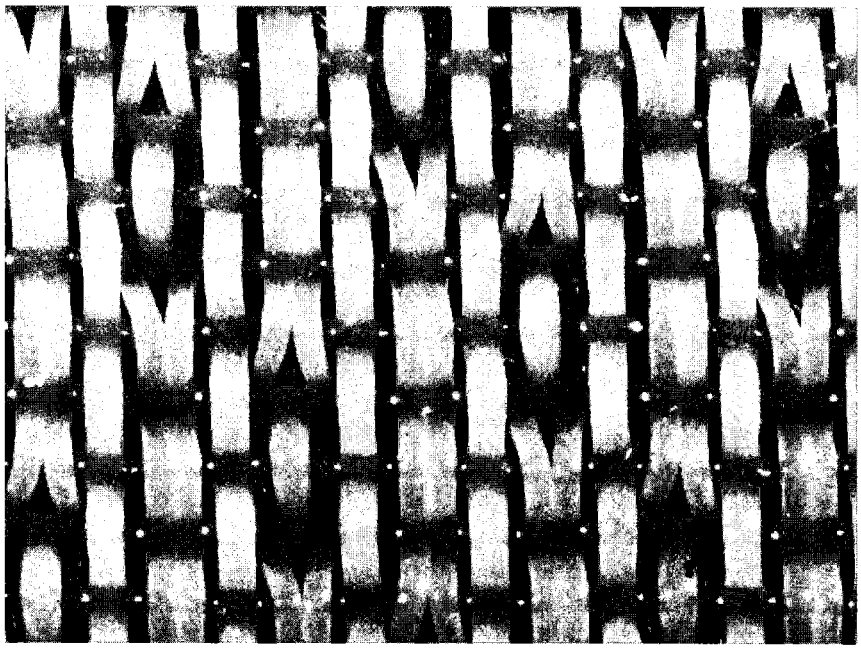
FIG. 5 is a planar photograph of an upper side surface of the fabric according to the invention.
Figure 6:
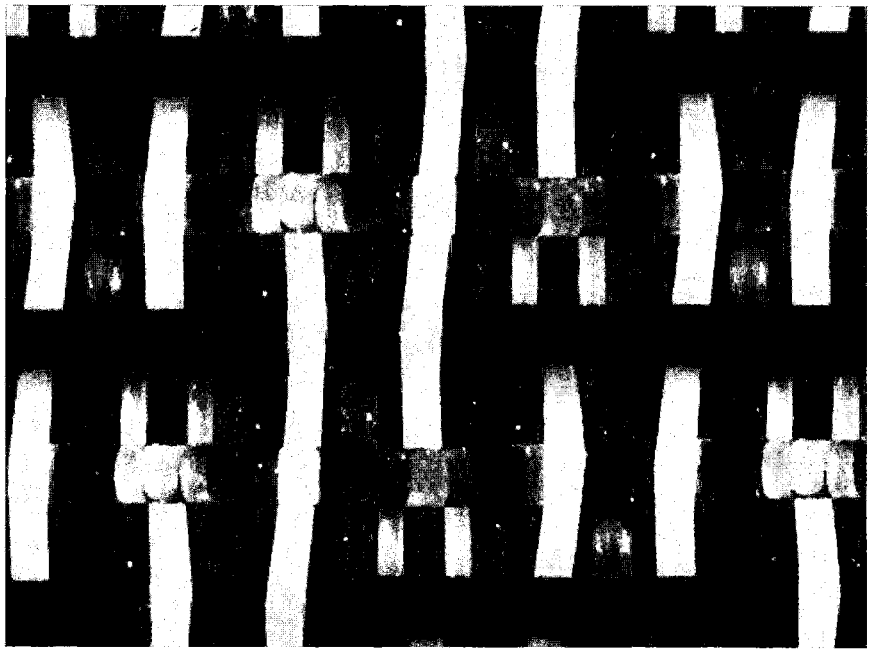
FIG. 6 is a planar photograph of a lower side surface of the fabric according to the invention.
Figure 7:
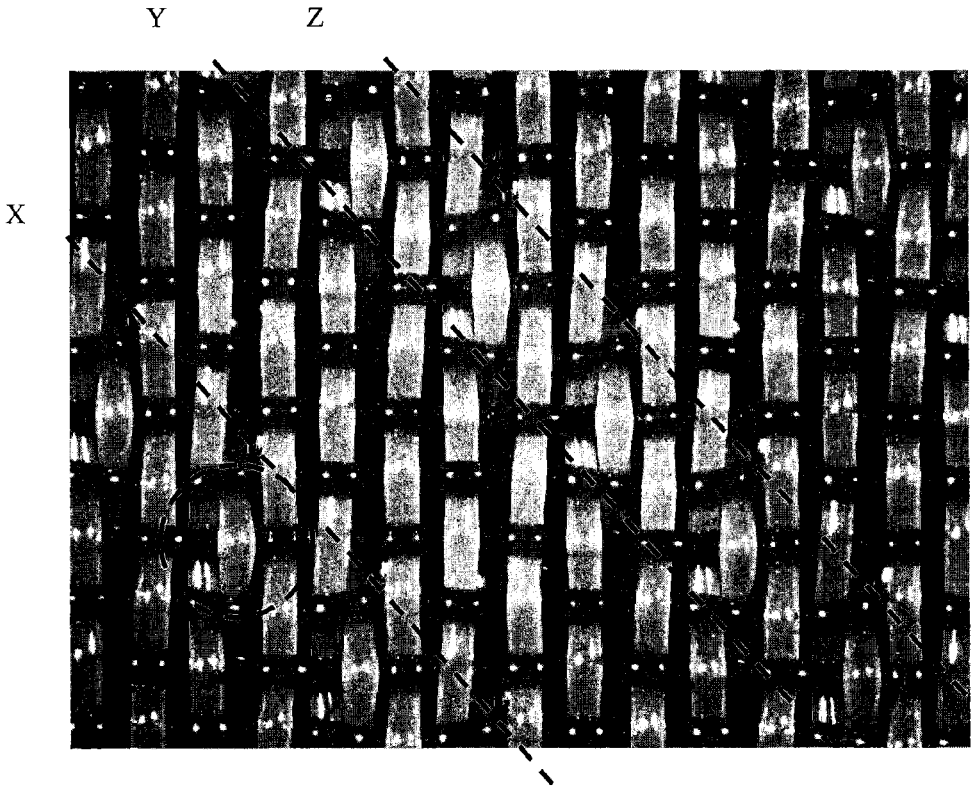
FIG. 7 is a planar photograph of an upper side surface of a fabric according to the conventional invention.

FIG. 5 is a partial photograph showing an example of the upper surface side of the industrial two-layer fabric of the example 1. FIG. 6 is a partial photograph of the lower surface side of the fabric of the example 1. FIG. 7 is a partial photograph of the upper surface side of an industrial two-layer fabric relating to the related art. In the industrial two-layer fabric shown in FIGS. 5 and 6, the upper side fabric is comprised of an upper side warp design having a first warp set and an upper side warp design having a second warp set. The lower side fabric is comprised only of binding yarns. The binding yarns each appears from between the upper side warps of the first warp set when woven with an upper side weft.

The fabric shown in FIG. 7 is a fabric obtained by interweaving upper and lower fabrics by complementing a knuckle-free position of an upper side warp with a knuckle formed with a warp binding yarn while carrying out successive interweaving, and thereby preventing collapse of the design.

In the fabric of FIG. 7, since the warp binding yarn forms an intersection with the upper side warp at a position where it forms a knuckle on the upper surface side, the warp binding yarn is not completely on the side of the upper side warp when they are arranged side by side. It is apparent from the photograph of FIG. 7 that the mesh openings at the position are clogged compared with another position. In addition, the knuckles complemented with the warp binding yarn are arranged successively in an oblique direction so that a clear boundary appears between a portion where mesh openings are open between lines X and Y of FIG. 7 and a portion where mesh openings are clogged between lines Y-Z of FIG. 7. Generation of spots in an oblique direction can be confirmed. They remain as spots of dehydration and give paper an oblique mark in a papermaking step.

Further, in the conventional fabrics using only one kind of an upper side warp for an upper side warp that constitutes an upper side surface, the upper side warp and a lower side warp should cooperate with each other as a warp to form an upper side surface design without collapsing it. The upper side warp and the lower side warp form a design corresponding to a single warp. For example, at a position where the lower side warp is woven with an upper side weft, the upper side warp is not woven with the upper side weft which it is originally supposed to be woven with and it passes under the upper side weft. At this time, two warps overlap each other in a perpendicular direction of the fabric and form a design corresponding to a single warp, but they are actually misaligned in a horizontal direction. In particular, at a position where upper and lower warps replace each other, these two warps lie side by side as the warps between the lines Y and Z of FIG. 7. Further, at the other position, an upper side warp and a lower side warp do not overlap completely. Thus, due to misalignment of the warp and a large difference between an open portion and a clogged portion of the mesh openings at a position where a binding yarn goes up and down, a sufficient dehydration route is not secured in places. In a step of dehydration of raw materials which have landed on a papermaking machine, it may lead to a dehydration mark or a transferred wire mark and the paper thus manufactured inevitably has irregularities or uneven thickness. In the binding design of the conventional fabrics, the binding is effected by the cooperation of the binding yarn and the warp so that they are inevitably drawn from the surface in places. This is because warps including a warp binding yarn should go up and down different from warps which form a warp design only from an upper side warp or a lower side warp.

In addition, in the conventional fabrics, there is also a difference in the overlapping manner of an upper side warp and a lower side warp between a set of a binding yarn and a set of an upper side warp. The term "set of a warp" as used herein means a set of an upper side warp to be woven only with an upper side weft and a lower side warp to be woven only with a lower side weft. In such a structure, when a wire is viewed in a perpendicular direction from the upper surface side to the lower surface side, the upper and lower warps substantially overlap each other. With regards to the set of a binding yarn, on the other hand, two warps are placed perpendicularly. One of them should be woven with both upper and lower wefts and a design corresponding to a single warp should be formed so that there exists a position where these two warps replace and cross each other. Different from the set of a warp, the warps of the set of a binding yarn do not completely overlap perpendicularly. In particular, at a position where the two warps replace each other, they lie side by side so that the mesh openings are clogged at this position, which may become a factor for clogging of a dehydration route, deterioration in smoothness on the surface of the fabric, and the like and as a result, cause dehydration marks.

In one example of the industrial two-layer fabric according to the invention, on the other hand, warps of the upper side surface are comprised of two kinds of warps, that is, a set of two upper side warps and a set of a single upper side warp. When upper and lower wires or fabrics are bound in the two-layer fabric of the present invention, the binding yarn appears from between the two warps of the first warp set when woven with an upper side weft so that the surface design can be formed without changing the shape of the warp design or replacing warps each other and at the same time, the warps of the first warp set lie always at the same position.

In the fabric of the present example, different from the conventional fabrics having a replacing and crossing position of warps, warps are free of misalignment in a horizontal direction or one-sided alignment. A sufficient dehydration route is secured in the fabric of the present example, because a warp ratio on the lower surface side is small. This suggests that the mesh openings on the upper surface side tend to be clogged compared with the conventional fabrics, but a dehydration route in a perpendicular direction is secured sufficiently so that the structure of the present example has no adverse effect on the dehydration property. It is needless to say that the dehydration route in an oblique direction is also secured sufficiently so that the fabric of the present example is free of partial clogging of the mesh openings. The structure of the present example has therefore a marked effect for achieving a uniform dehydration property and excellent surface smoothness. Such a structure and function can be understood from the comparison between the photographs of FIGS. 5 and 7.

In the fabric of the present example, the binding yarn appears from between the two warps of the first warp set so that it is free of the influence of the misalignment of warps which will otherwise occur because the binding yarn goes up and down. In Example 1, the design corresponding to one warp is formed by the first warp set so that neither misalignment in the horizontal direction nor one-sided alignment occurs in places, which owes to a space corresponding to two warps secured in advance. In the related art, on the other hand, upper and lower warps replace or cooperate each other to bind upper and lower wires without collapsing the surface design. At the bound position, there inevitably occurs surface roughness of the fabric due to drawing of wefts from the surface or clogging of a dehydration route due to warps arranged side by side. Then, paper manufactured using the resulting fabric is likely to have a dehydration mark or a transferred wire mark.

EXAMPLE 2

Figure 2:
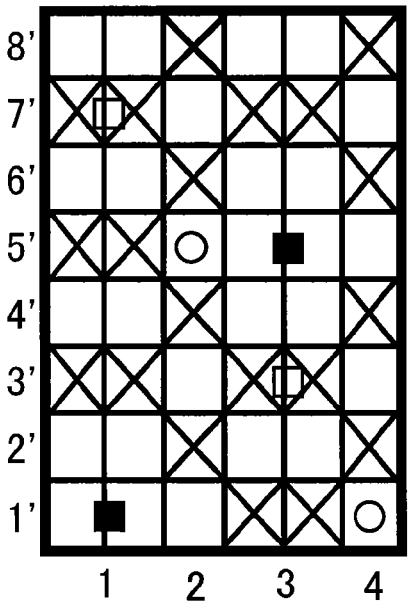
FIG. 2 is a design diagram showing a complete design of Example 2 of the invention.

FIG. 2 is the design diagram of an industrial two-layer fabric of Example 2 according to the invention.

In Example 2, the fabric has a lower side warp which the fabric of Example 1 does not have. Described specifically, the two-layer fabric of Example 2 is a 4-shaft fabric in which first warp sets (1, 3) of upper and lower warps each comprised of two upper side warps and one binding yarn. The binding yarn is one of lower side warps that weaves an upper side weft and a lower side weft thereby binds the upper side fabric and the lower side fabric of the two-layer fabric. Second warp sets (2, 4) of upper and lower warps each comprised of an upper side warp and a lower side warp that is placed below the upper side warp. The first warp set and the second warp set are arranged alternately.

In FIG. 2, upper side wefts (1', 2', 3', 4', 5', 6', 7' and 8') and lower side wefts (1', 3', 5' and 7') are arranged at a ratio of 2:1. The presence of the lower side wefts is identified at the rows that white squares or white circles appear in FIG. 2.

In the upper side fabric, an upper side warp alternately passes over upper side wefts (shown as X in a box in FIG. 2) and under upper side wefts (shown as blank box in FIG. 2) and thus forms a 1/1 upper side warp design (plain weave fabric design in combination with upper side wefts). A first warp set of two upper side warps and a binding yarn (1 or 3) and a second warp set of an upper side warp and a lower side warp (2 or 4) are arranged alternately. The two upper side warps of the first warp set (1 or 3) are each woven with the same upper side weft (1', 3', 5' or 7') and as a set, constitute a 1/1 upper side warp design corresponding to a single warp that is generally placed in a plain weave fabric.

The binding yarn of the first warp set is placed under the two upper side warps of the first warp set and binds an upper side fabric and a lower side fabric while appearing from between the two upper side warps of the first warp set. At a position where the warp binding yarn (1 or 3) passes above one of the upper side wefts (1' and 5', respectively) as shown by a black square "■", the warp binding yarn (1 or 3) is placed between the two upper side warps (1 or 3) of the first warp set, the two upper side warps at the position pass below the same one of the upper side wefts (1' and 5', respectively), as shown by blank boxes, whereby the two upper side warps and the warp binding yarn of the first warp set form the 1/1 upper side warp design.

The binding yarn 1 which is a lower side warp passes under the lower side weft 7', passes over lower side wefts 1', 3' and 5', and is woven with an upper side weft 1'. A binding yarn 3 adjacent thereto passes under a lower side weft 3', passes over lower side wefts 1', 5', and 7', and is woven with an upper side weft 5'.

No limitation is imposed on the design of the lower side fabric. In Example 2, the fabric has a long crimp of a lower side weft so that it has a good wear resistance. More specifically, the warp binding yarn 1 which is a lower side warp passes under one lower side weft 1' and over three lower side wefts 3', 5' and 7' and thus forms a 1/3 lower warp design.

By using the industrial two-layer fabric of Example 2, it is possible to provide an industrial two-layer fabric free of misalignment of a binding yarn at an interwoven position and therefore capable of having a uniform dehydration property throughout the fabric, excellent in surface smoothness, rigidity, water drainability, wear resistance, and fiber supporting property, and not increasing the thickness of a wire.

EXAMPLE 3

Figure 3:
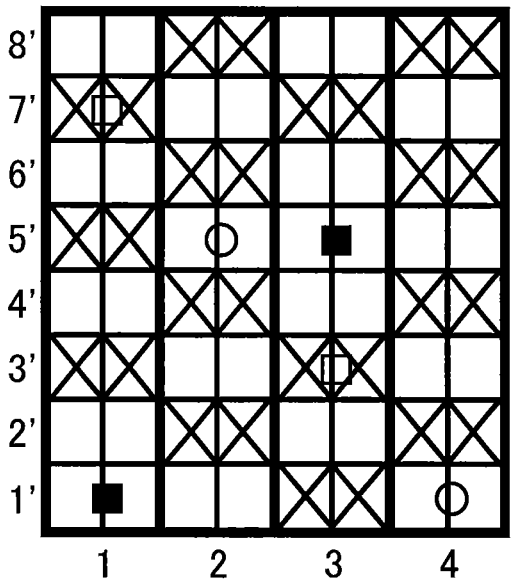
FIG. 3 is a design diagram showing a complete design of Example 3 of the invention.

FIG. 3 is the design diagram of an industrial two-layer fabric of Example 3 according to the invention.

In Example 2, the upper side fabric is comprised of a first warp set that contains two upper side warps and a second warp set that contains one upper side warp. The fabric of Example 3 is comprised of a first warp set that contains two upper side warps and a second warp set that also contains two upper side warps. Described specifically, it is a 4-shaft fabric in which first warp sets (1, 3) are comprised of two upper side warps and a binding yarn which is one of lower side warps. Second warp sets (2, 4) are comprised of two upper side warps and a lower side warp. The first warp set and the second warp set are arranged alternately.

In FIG. 3, upper side wefts (1', 2', 3', 4', 5', 6', 7' and 8') and lower side wefts (1', 3', 5' and 7') are arranged at a ratio of 2:1. The presence of the lower side wefts is likewise identified at the rows that white squares or white circles appear in FIG. 3.

In the upper side fabric, an upper side warp alternately passes over and under upper side wefts and forms a 1/1 upper side warp design. A first warp set of two upper side warps and a binding yarn (1 or 3) and a second warp set of two upper side warps and a lower side warp (2 or 4) are arranged alternately. The two upper side warps of the first warp set (1 or 3) are each woven with the same upper side weft (1', 3', 5' or 7') and as a set, constitute a 1/1 upper side warp design corresponding to a single warp that is generally placed in a plain weave fabric. The two upper side warps of the second warp set (2 or 4) are also each woven with the same upper side weft (2', 4', 6' or 8') and as a set, constitute a 1/1 upper side warp design corresponding to a single warp that is generally placed in a plain weave fabric.

The binding yarn of the first warp set is placed under the two upper side warps of the first warp set and binds an upper side fabric and a lower side fabric while appearing from between the two upper side warps of the first warp set. At a position where the warp binding yarn (1 or 3) passes above one of the upper side wefts (1' and 5', respectively) as shown by a black square "■", the warp binding yarn (1 or 3) is placed between the two upper side warps (1 or 3) of the first warp set, the two upper side warps at the position pass below the same one of the upper side wefts (1' and 5', respectively), as shown by blank boxes, whereby the two upper side warps and the warp binding yarn of the first warp set form the 1/1 upper side warp design.

No limitation is imposed on the design of the lower side fabric. In Example 3, the fabric has a long crimp of a lower side weft so that it has a good wear resistance. More specifically, the warp binding yarn 1 which is a lower side warp passes under one lower side weft 7' (shown as a white square in FIG. 3) and over three lower side wefts 1', 3' and 5' and thus forms a 1/3 lower warp design.

A lower side warp 2 passes under a lower side weft 5' (shown as a white circle in FIG. 3), passes over lower side wefts 7', 1' and 3'. A lower side warp 4 passes under a lower side weft 1', passes over lower side wefts 3', 5' and 7'. Thus the lower side warps also form a 1/3 lower warp design.

By using the industrial two-layer fabric of Example 3, it is possible to provide an industrial two-layer fabric free of misalignment of a binding yarn at an interwoven position and therefore capable of having a uniform dehydration property throughout the fabric, excellent in surface smoothness, rigidity, water drainability, wear resistance, and fiber supporting property, and not increasing the thickness of a fabric.

EXAMPLE 4

Figure 4:
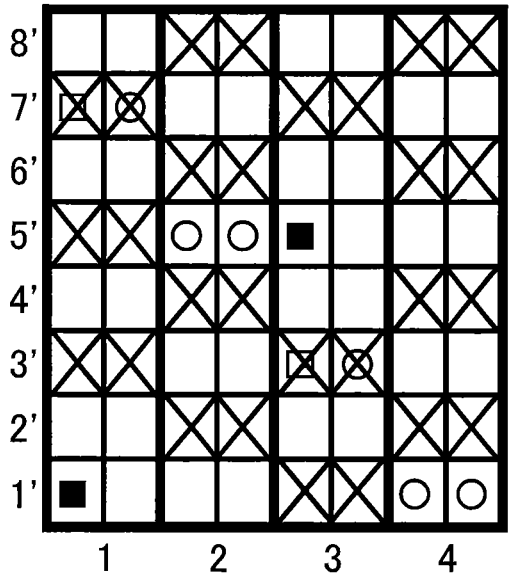
FIG. 4 is a design diagram showing a complete design of Example 4 of the invention.

FIG. 4 is the design diagram of an industrial two-layer fabric of Example 4 according to the invention.

In Example 3, a binding yarn or an lower side warp is placed under two-upper side warps of the first or second warp set, while in the present Example 4, two warps are placed under the two upper side warps of the first or second warp set. Described specifically, the fabric of the present example is a 4-shaft fabric in which a first warp set of upper and lower warps (1, 3) comprised of two upper side warps, a binding yarn which is one of lower side warps, and a lower side warp, and a second warp set of upper and lower warps (2, 4) comprised of two upper side warps and two lower side warps. The first and second warp sets are arranged alternately. Like examples of FIGS. 2 and 3, upper side wefts and lower side wefts are arranged at a ratio of 2:1.

The two upper side warps of the first warp set (1 or 3) are each woven with the same upper side weft (1', 3', 5' or 7') and as a set, constitute a 1/1 upper side warp design. The two upper side warps of the second warp set (2 or 4) are also each woven with the same upper side weft (2', 4', 6' or 8') and as a set, constitute a 1/1 upper side warp design.

The binding yarn of the first warp set is placed under the two upper side warps of the first warp set and binds an upper side fabric and a lower side fabric while appearing from between the two upper side warps of the first warp set. At a position where the warp binding yarn (1 or 3) passes above one of the upper side wefts (1' and 5', respectively) as shown by a black square "■", the warp binding yarn (1 or 3) is placed between the two upper side warps (1 or 3) of the first warp set, the two upper side warps at the position pass below the same one of the upper side wefts (1' and 5', respectively), as shown by blank boxes, whereby the two upper side warps and the warp binding yarn of the first warp set form the 1/1 upper side warp design.

No limitation is imposed on the design of the lower side fabric. In Example 4, like Example 2 and 3, the fabric has a long crimp of a lower side weft so that it has a good wear resistance. More specifically, the warp binding yarn 1, which is a lower side warp, and another lower side warp 1 of the first warp set pass under one lower side weft 7' (shown as a white square and a white circle in FIG. 4) and over three lower side wefts 1', 3' and 5' and thus forms a 1/3 lower warp design.

Two lower side warps 2 pass under a lower side weft 5' (shown as two white circles in FIG. 4), pass over lower side wefts 7', 1' and 3'. Two lower side warps 4 pass under a lower side weft 1', pass over lower side wefts 3', 5' and 7'. Thus the lower side warps also form a 1/3 lower warp design.

By using the industrial two-layer fabric of Example 4, it is possible to provide an industrial two-layer fabric free of misalignment of a binding yarn at an interwoven position and therefore capable of having a uniform dehydration property throughout the fabric, excellent in surface smoothness, rigidity, water drainability, wear resistance, and fiber supporting property, and not increasing the thickness of a wire.

The preceding description has been presented only to illustrate and describe exemplary embodiments of the present industrial two-layer fabric. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An industrial two-layer fabric comprising:

an upper side fabric comprising upper side warps and upper side wefts, each of the upper side warps forms an upper side warp design; and a lower side fabric comprising lower side warps and lower side wefts;

wherein the upper side warps comprise a first warp set and a second warp set, the first warp set contains adjacent two of the upper side warps and a first one of the lower side warps, the adjacent two of the upper side warps are woven with the same upper side wefts, the first one of the lower side warps functions as a warp binding yarn and is woven with an upper side weft and a lower side weft thereby binds the upper side fabric and the lower side fabric, the second warp set contains one of the upper side warps, the first warp set and the second warp set are placed alternately;

wherein, at a position where the warp binding yarn passes above one of the upper side wefts, the warp binding yarn is placed between the adjacent two upper side warps of the first warp set, the adjacent two upper side warps at the position pass below the same one of the upper side wefts, whereby the adjacent two upper side warps and the warp binding yarn of the first warp set form the upper side warp design.

2. An industrial two-layer fabric according to claim 1, wherein the second warp set further comprises one of the lower side warps placed below the one of the upper side warps.

3. An industrial two-layer fabric according to claim 1, wherein the second warp set comprises two of the upper side warps that weave the same upper side wefts.

4. An industrial two-layer fabric according to claim 2, wherein the second warp set comprises two of the upper side warps that weave the same upper side wefts.

5. The industrial two-layer fabric according to claim 1, wherein any of the lower side warps functions as the warp binding yarn that binds the upper side fabric and the lower side fabric.

6. The industrial two-layer fabric according to claim 5, wherein the warp binding yarn passes over one of the upper side wefts and passes under at least one the lower side wefts in a minimum repeating unit.

7. An industrial two-layer fabric according to claim 1, wherein the first warp set further comprises a second one of the lower side warps placed below the one of the upper side warps adjacent to the first one of the lower side warps, the first and second ones of the lower side warps are woven with a same one of the lower side wefts.

8. The industrial two-layer fabric according to claim 1, wherein the upper side warps of the first warp set have a smaller diameter than the upper side warp of the second warp set.

9. The industrial two-layer fabric according to claim 1, wherein the upper side fabric weave design is any one of plain weave, twill weave, broken twill weave, satin weave, and broken satin weave.

10. The industrial two-layer fabric according to claim 1, wherein one or more auxiliary wefts are placed between the upper side wefts.

11. The industrial two-layer fabric according to claim 1, wherein the number of the upper side wefts is at least equal to but not greater than twice the number of the lower side wefts.

* * * * *